United States Patent [19]

Heintz

[11] Patent Number: 4,941,420

[45] Date of Patent: Jul. 17, 1990

[54] SAILBOAT ROOM CONTROL DEVICE

[76] Inventor: Harold L. Heintz, 8422 New York Dr., Stockton, Calif.

[21] Appl. No.: 310,948

[22] Filed: Feb. 16, 1989

[51] Int. Cl.[5] ..... B63H 9/04

[52] U.S. Cl. ..... 114/102

[58] Field of Search ..... 114/97, 101, 102, 39.1, 114/98; 254/403, 411; 242/285; 188/65.1

[56] References Cited

U.S. PATENT DOCUMENTS

| | | | |
|---|---|---|---|
| 3,972,300 | 8/1976 | Adamski | 114/39.1 |
| 4,138,962 | 2/1979 | Waelder | 114/102 |
| 4,630,564 | 12/1986 | Duckman et al. | 114/98 |

*Primary Examiner*—Joseph F. Peters, Jr.
*Assistant Examiner*—Jesus D. Sotelo
*Attorney, Agent, or Firm*—John R. Murtha

[57] ABSTRACT

A device for controlling the swinging of a boom on a sailboat comprising a line fixed at opposite ends to opposite gunwales of the boat and passing intermediate its ends about a drum secured to the boom.

1 Claim, 1 Drawing Sheet

SAILBOAT ROOM CONTROL DEVICE

The invention relates to a device for controlling the boom on a sailboat when a jibe occurs, as in a change from a starboard tack to a port tack, when sailing with the wind.

When a sailboat changes direction, i.e. goes from one tack to another, as for instance, when it changes from a starboard tack to a port tack, or vice versa, the boat undergoes a complete reversal in attitude. The sail, which had been full of wind, suddenly goes slack during the turning of the boat's hull from the old direction toward the new and, as the boat comes about to the new direction, the sail catches the wind again and the boom of the mainsail swings around the mast across the deck from one side to the other. This action of the boom can be very hazardous to the crew of the boat inasmuch as it takes place within a very short time and the boom travels across the deck at a very high rate of speed. Crew members may be struck and injured by the boom and, sometimes, knocked overboard.

Attempts have been made in the past to control and slow the swing of the boom at such time and the principal device for doing so is a French appratus known as Le Walder. This device, however, has proven to have several severe drawbacks in practice due to defects in its design.

Accordingly, the present invention has for its object the provision of a boom control device that is compact, lightweight and more efficient in operation than the prior art.

Figure 2:
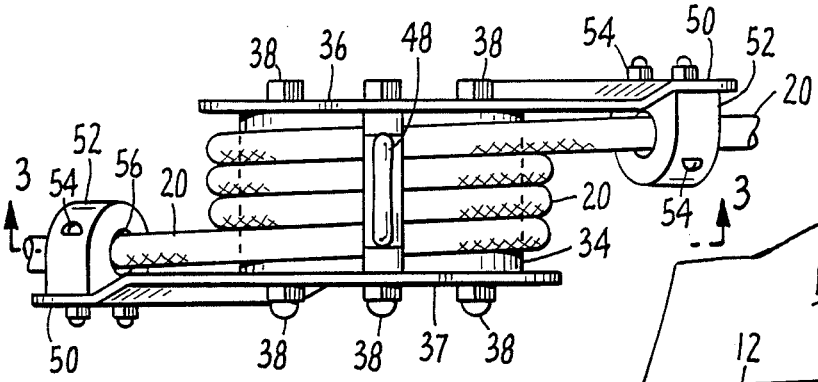
Figure 1:
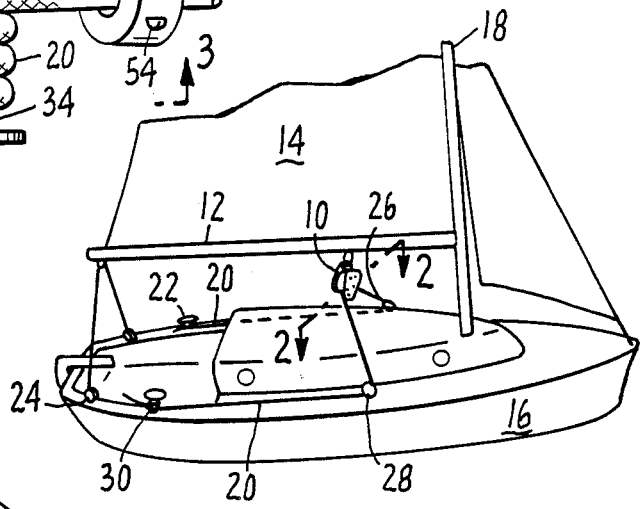
Figure 3:
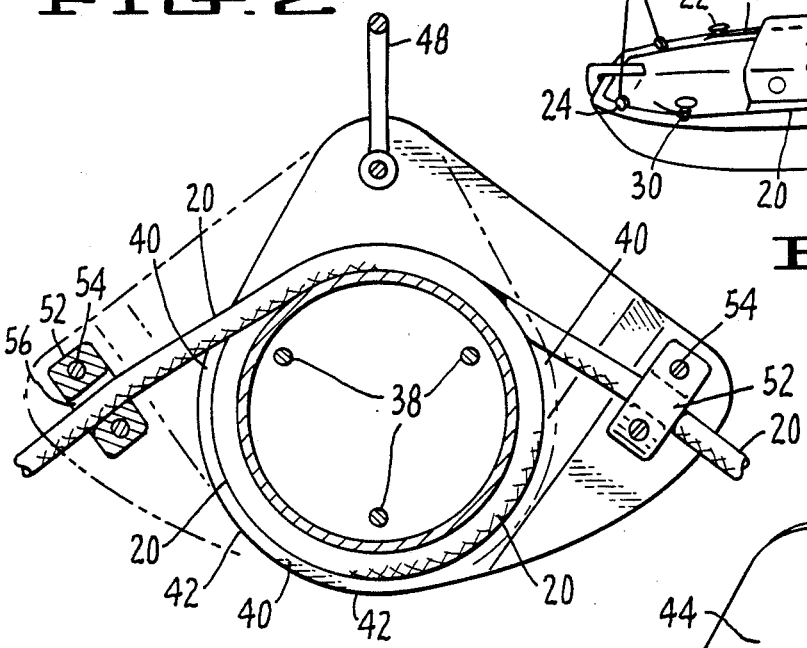
Figure 4:
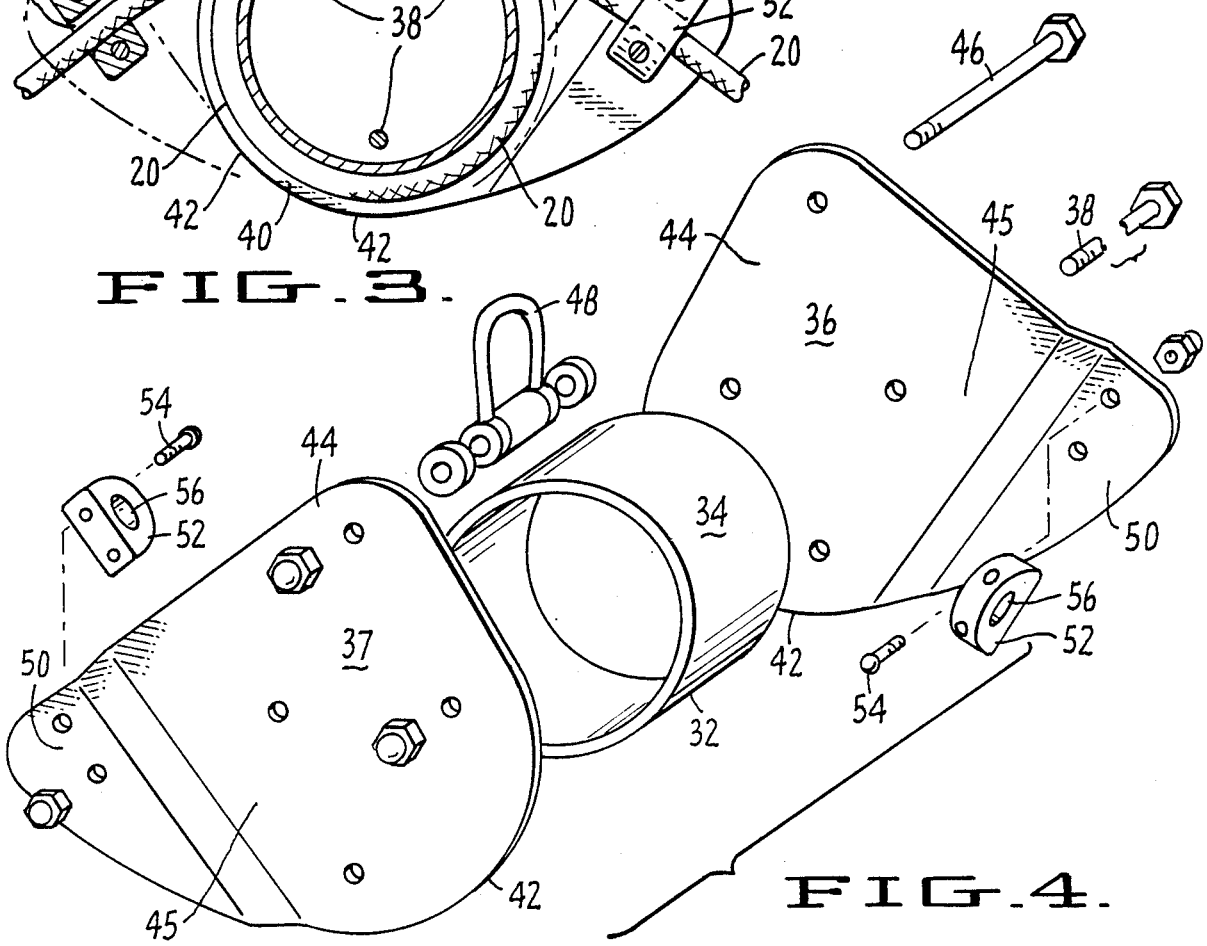

In the accompanying drawings, in which similar reference numerals refer to similar parts, FIG. 1 shows the present device as applied to a sailboat to control the jibe of the mainsail boom, FIG. 2 is a top view of the device, FIG. 3 is a sectional view taken along the line 3—3 in FIG. 2, and FIG. 4 is an exploded view showing how the device is assembled.

As is best seen in FIG. 1, the present device 10 is suspended from the boom 12 of the main sail 14 of the boat 16 at a point about one-third or one quarter aft of the mast 18. A line, or rope 20, runs from a cleat 22 on the port side of the boat 16 adjacent the cockpit 24. From the cleat 22, the line 20 runs forward to a pulley 26 then up to the device 10, down to a pulley 28 on the starboard side of the boat and on back to a cleat 30 adjacent the cockpit 24. At this point the line 20 is available to the person at the helm of the boat who can vary the amount of tension on the system as required.

Referring to FIG. 4, the applicant's device comprises a cylindrical, hollow drum 32 having a smooth outer surface 34. A pair of substantially triangular plates 36,37 are spaced substantially parallel to each other at the ends of the cylndrical drum and are held together by three bolts 38,38 that pass through the drum's hollow interior. One of the plates has threaded holes for the three main bolts so that the nuts 39,39 on these bolts act as lock nuts. The plates 36,37 overlap the outer surface of the drum 32 so as to form end walls 40,40 that serve to confine the coils of rope 20 on the drum 32.

The plates 36,37 are, for the most part, flat and have curved edge portions 42,42 that are positioned concentrically to the outer surface 34 of the drum 32. The plates 36,37 are also provided with first and second extensions, or portions 44,45, that extend to points closely adjacent to but just beyond the circumference of the drum 32 when wrapped with a coil of rope 20. The first extensions 44,44 of the plates 36,37 are positioned in opposing alignment and a bolt 46 is mounted therein. The bolt 46 carries a clevis 48 that attaches to a pivotal hook (not shown) on the boom 12 so as to support the device just below the boom.

Second extensions, or portions 45,45, are provided on the plates 36,37 and these extensions are disposed in opposite directions to each other, that is, the extension 45 on one plate 36 extends toward the port side of the boat 16 while the extension 45 on the other plate 37 extends toward the starboard side of the boat. Each of these extensions terminates in a segment 50 that is offset slightly outward from the remainder of the plate. Rope guides 52,52 are mounted on these offset segments 50,50 by means of the the round-headed screw bolts 54,54. The guides 52,52 are made from a smooth plastic and have openings 56,56 through which the rope, or line 20, passes onto the cylindrical drum 32. To insure a neat wrap of the rope on the drum, that is, the laying of the rope in four adjacent coils with no overlapping of the coils, the guides 52,52 are positioned tangentially with respect to the outer surface 34 of the drum 32. This positioning of the guides 52,52, together with the outward offset of the terminal segments 50,50 results in the laying of four coils of rope in a neat wrap on the drum.

I claim:

1. A device for controlling the swinging movement of the main boom on a sailboat, said device comprising, (a) a clindrical hollow drum having a smooth outer surface to receive a coil of rope, (b) a pair of spaced, substantially parallel plates secured to the ends of the drum and overlapping the outer surface of the drum to form end walls for confining a coil of rope on the outer surface of the drum, (c) each of said plates being substantially triangular in shape and having a curved edge portion concentric to the outer surface of the drum, (d) each of said plates also having first and second extensions with end portions spaced closely adjacent to, but beyond, the circumference of the drum when wrapped with a coil of rope, (e) said first extensions on the plates disposed opposite each other and provided with means for pivotally attaching the device to the main boom for the sailboat, (f) said second extensions on the plates being disposed in oposite directions to each other and each terminating in an offset segment, and (g) rope guides mounted on said offset segments positioned tangentially to the cylindrical outer surface of the drum whereby a coil of rope can pass freely therethrough so as to be laid in a neat wrap on the outer surface of the drum.

* * * * *